US011181848B2

(12) United States Patent
Ochi et al.

(10) Patent No.: US 11,181,848 B2
(45) Date of Patent: Nov. 23, 2021

(54) LIQUID DEVELOPER AND METHOD OF PRODUCING LIQUID DEVELOPER

(71) Applicant: CANON KABUSHIKI KAISHA, Tokyo (JP)

(72) Inventors: Kouichirou Ochi, Chiba (JP); Yuzo Tokunaga, Chiba (JP); Tomoyo Miyakai, Tokyo (JP); Akifumi Matsubara, Kashiwa (JP); Takashi Hirasa, Moriya (JP); Hayato Ida, Toride (JP); Yasutaka Akashi, Yokohama (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/794,925

(22) Filed: Feb. 19, 2020

(65) Prior Publication Data

US 2020/0272068 A1 Aug. 27, 2020

(30) Foreign Application Priority Data

Feb. 25, 2019 (JP) ..... JP2019-031466

(51) Int. Cl.

| | |
|---|---|
| ***G03G 9/135*** | (2006.01) |
| ***G03G 9/125*** | (2006.01) |
| ***G03G 9/13*** | (2006.01) |
| ***G03G 9/08*** | (2006.01) |

(52) U.S. Cl.

CPC ..... *G03G 9/1355* (2013.01); *G03G 9/0806* (2013.01); *G03G 9/125* (2013.01); *G03G 9/131* (2013.01); *G03G 9/132* (2013.01); *G03G 9/133* (2013.01)

(58) Field of Classification Search

CPC .... G03G 9/1355; G03G 9/0806; G03G 9/125; G03G 9/131; G03G 9/132; G03G 9/133

See application file for complete search history.

(56) References Cited

U.S. PATENT DOCUMENTS

| | | | | |
|---|---|---|---|---|
| 4,904,562 | A | 2/1990 | Yusa et al. | |
| 4,983,486 | A * | 1/1991 | Kato | G03G 9/131 430/115 |
| 5,169,738 | A | 12/1992 | Tanikawa et al. | |
| 5,212,524 | A | 5/1993 | Tanikawa et al. | |
| 5,215,854 | A | 6/1993 | Yamazaki et al. | |
| 5,268,248 | A | 12/1993 | Tanikawa et al. | |
| 5,296,326 | A | 3/1994 | Taya et al. | |
| 5,330,871 | A | 7/1994 | Tanikawa et al. | |
| 5,348,829 | A | 9/1994 | Uchiyama et al. | |
| 5,480,755 | A | 1/1996 | Uchiyama et al. | |
| 5,504,272 | A | 4/1996 | Uchiyama et al. | |
| 5,573,880 | A | 11/1996 | Mayama et al. | |
| 5,641,600 | A | 6/1997 | Kotaki et al. | |
| 5,712,069 | A | 1/1998 | Baba et al. | |
| 5,766,814 | A | 6/1998 | Baba et al. | |
| 6,083,655 | A | 7/2000 | Itabashi et al. | |
| 6,106,990 | A | 8/2000 | Tazawa et al. | |
| 6,159,648 | A | 12/2000 | Baba et al. | |
| 6,165,663 | A | 12/2000 | Baba et al. | |
| 6,566,028 | B2 | 5/2003 | Tazawa et al. | |
| 6,632,577 | B2 | 10/2003 | Akashi et al. | |
| 7,361,400 | B2 | 4/2008 | Shimamura et al. | |
| 7,361,442 | B2 | 4/2008 | Otake et al. | |
| 7,796,926 | B2 | 9/2010 | Matsuda et al. | |
| 8,399,170 | B2 | 3/2013 | Iwase et al. | |
| 8,538,303 | B2 | 9/2013 | Matsuda et al. | |
| 8,722,302 | B2 | 5/2014 | Maeda et al. | |
| 9,057,970 | B2 | 6/2015 | Ida et al. | |
| 9,348,247 | B2 | 5/2016 | Ida et al. | |
| 9,540,483 | B2 | 1/2017 | Ida et al. | |
| 9,696,644 | B2 | 7/2017 | Ida et al. | |
| 9,897,934 | B2 | 2/2018 | Tamura et al. | |
| 10,012,920 | B2 | 7/2018 | Shibata et al. | |
| 10,036,970 | B2 | 7/2018 | Kanno et al. | |
| 10,078,281 | B2 | 9/2018 | Ida et al. | |
| 10,088,765 | B2 | 10/2018 | Miyakai et al. | |
| 10,146,146 | B2 | 12/2018 | Komatsu et al. | |
| 10,162,281 | B2 | 12/2018 | Tsuchida et al. | |
| 10,175,595 | B2 | 1/2019 | Onozaki et al. | |
| 10,197,936 | B2 | 2/2019 | Onozaki et al. | |
| 10,203,619 | B2 | 2/2019 | Yamashita et al. | |
| 10,228,629 | B2 | 3/2019 | Tamura et al. | |

(Continued)

FOREIGN PATENT DOCUMENTS

| | | |
|---|---|---|
| JP | 2003-241439 | 8/2003 |
| JP | 2009-244834 | 10/2009 |

(Continued)

OTHER PUBLICATIONS

U.S. Appl. No. 16/534,343, filed Aug. 7, 2019, Kentaro Kamae.

(Continued)

*Primary Examiner* — John A McPherson

*Assistant Examiner* — Richard David Champion

(74) *Attorney, Agent, or Firm* — Venable LLP

(57) ABSTRACT

A liquid developer containing a liquid carrier and a toner particle that is insoluble in the liquid carrier, wherein a particular substructure is bonded through a covalent bond to a surface of the toner particle, and a method of producing a liquid developer containing a liquid carrier and a toner particle that is insoluble in the liquid carrier, the method comprising a step (I) of covalently bonding, to a surface of the toner particle, a compound having a particular substructure.

5 Claims, No Drawings

(56) References Cited

U.S. PATENT DOCUMENTS

| | | | | |
|---|---|---|---|---|
| 10,353,312 | B2 | 7/2019 | Kamae et al. | |
| 10,401,748 | B2 | 9/2019 | Hashimoto et al. | |
| 10,451,986 | B2 | 10/2019 | Sano et al. | |
| 10,451,990 | B2 | 10/2019 | Kamae et al. | |
| 10,474,049 | B2 | 11/2019 | Onozaki et al. | |
| 10,514,624 | B2 | 12/2019 | Tamura et al. | |
| 2009/0011359 | A1* | 1/2009 | Iwase | G03G 9/122 430/115 |
| 2009/0233215 | A1 | 9/2009 | Ueno et al. | |
| 2010/0136474 | A1 | 6/2010 | Iwase et al. | |
| 2013/0108955 | A1 | 5/2013 | Shibata et al. | |
| 2013/0202998 | A1 | 8/2013 | Higashi et al. | |
| 2015/0099227 | A1 | 4/2015 | Ida et al. | |
| 2018/0046102 | A1 | 2/2018 | Tsuchida et al. | |
| 2018/0314176 | A1 | 11/2018 | Ikeda et al. | |
| 2018/0321607 | A1 | 11/2018 | Matsubara et al. | |
| 2018/0329333 | A1 | 11/2018 | Tokunaga et al. | |
| 2018/0348658 | A1 | 12/2018 | Tsuchida et al. | |
| 2019/0107794 | A1* | 4/2019 | Tokunaga | G03G 9/125 |
| 2019/0384193 | A1 | 12/2019 | Hashimoto et al. | |
| 2019/0384196 | A1 | 12/2019 | Kamae et al. | |
| 2019/0384202 | A1 | 12/2019 | Shirayama et al. | |
| 2020/0057397 | A1 | 2/2020 | Murayama et al. | |

FOREIGN PATENT DOCUMENTS

| | | | |
|---|---|---|---|
| WO | 2007/000974 | 1/2007 | |
| WO | 2007/000975 | 1/2007 | |
| WO | 2009/041634 | 4/2009 | |
| WO | WO-2017217410 A1 * | 12/2017 | G03G 9/122 |

OTHER PUBLICATIONS

U.S. Appl. No. 16/815,355, filed Mar. 11, 2020, Yuya Chimoto.

Harazaki, "Basics and Technology of Coatings", ISBN-10: 4906451381, ISBN-13: 978-4906451388 (2010).

* cited by examiner

LIQUID DEVELOPER AND METHOD OF PRODUCING LIQUID DEVELOPER

BACKGROUND OF THE INVENTION

Field of the Invention

The present disclosure relates to a liquid developer that is used in image-forming apparatuses that employ electrophotographic systems, e.g., electrophotographic methods, electrostatic recording methods, electrostatic printing, and so forth. The present disclosure also relates to a method of producing a liquid developer.

Description of the Related Art

The demand for colorization from image-forming apparatuses that utilize electrophotographic systems, e.g., copiers, facsimile machines, and printers, has been increasing in recent years. Within this context, the development is being actively pursued of high-image-quality, high-speed digital printers that employ electrophotographic technology using liquid developers, which have an excellent fine-line image reproducibility, an excellent gradation reproducibility, an excellent color reproducibility, and an excellent ability to carry out image formation at high speeds. In view of these circumstances, the development is required of liquid developers that exhibit even better characteristics.

In order to obtain particularly good developing characteristics, a high volume resistivity must be maintained while securing dispersion stability for the toner particles in the liquid developer.

Japanese Patent Application Laid-open No. 2009-244834 discloses a liquid developer including a toner particle constituted of a resin material and a dispersing agent that has an amine value.

WO 2009/041634 discloses the following:

a liquid developer production method that, by using an acid group-containing resin and a particle dispersing agent that is the reaction product of a polyamine compound and a hydroxycarboxylic acid self-condensate, can improve the dispersion stability of the colored resin particles and can enhance the developing characteristics.

SUMMARY OF THE INVENTION

However, with regard to the liquid developer described in Japanese Patent Application Laid-open No. 2009-244834, it was found that an excellent dispersion stability is not obtained due to an inadequate binding strength between the resin material of the toner particle and the toner particle dispersing agent having an amine value.

With regard to the liquid developer described in WO 2009/041634, it was again found that an excellent dispersion stability is not obtained due to an inadequate binding strength between the acid group-bearing resin and the toner particle dispersing agent.

On the other hand, the toner particle dispersibility is improved when the amount of dispersing agent for the toner particle is increased; however, due to the increase in the toner particle dispersing agent that is released into the liquid carrier, the volume resistivity of the liquid developer is reduced and the developing performance then ends up declining.

The present disclosure therefore provides a liquid developer that exhibits a high volume resistivity and an excellent dispersion stability. The present disclosure also provides a method of producing a liquid developer that exhibits a high volume resistivity and an excellent dispersion stability.

As a result of intensive investigations, the present inventors found that a liquid developer exhibiting a high volume resistivity and a high dispersion stability is obtained by providing a structure in which a particular substructure is bonded through a covalent bond to the toner particle surface.

That is, a liquid developer of the present disclosure is a liquid developer containing:

a liquid carrier; and a toner particle that is insoluble in the liquid carrier, wherein at least one substructure selected from the group consisting of a substructure represented by formula (1) below and a substructure represented by formula (1') below is bonded through a covalent bond to a surface of the toner particle.

(1)

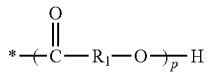

(1')

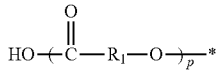

Where, $R_1$ represents a $C_{6-20}$ alkylene group optionally having a substituent or a $C_{6-20}$ cycloalkylene group optionally having a substituent; p represents an integer equal to or greater than 1; and * represents a bonding site to the surface of the toner particle.

Moreover, a method of producing a liquid developer of the present disclosure is a method of producing a liquid developer containing a liquid carrier and a toner particle that is insoluble in the liquid carrier, the method comprising:

a step (I) of covalently bonding, to a surface of the toner particle, a compound having at least one substructure selected from the group consisting of a substructure represented by formula (3) below and a substructure represented by formula (3') below.

(3)

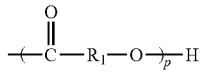

(3')

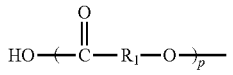

Where, $R_1$ represents a $C_{6-20}$ alkylene group optionally having a substituent or a $C_{6-20}$ cycloalkylene group optionally having a substituent, and p represents an integer equal to or greater than 1.

According to the present disclosure, a liquid developer that exhibits a high volume resistivity and an excellent dispersion stability can be provided. Moreover, according to the present disclosure, a method of producing a liquid developer that exhibits a high volume resistivity and an excellent dispersion stability can be provided.

Further features of the present invention will become apparent from the following description of exemplary embodiments.

DESCRIPTION OF THE EMBODIMENTS

Unless specifically indicated otherwise, expressions such as "from XX to YY" and "XX to YY" that show numerical value ranges refer in the present disclosure to numerical value ranges that include the lower limit and upper limit that are the end points.

The present inventors hypothesize the following with regard to the mechanism by which the effects of the present disclosure are expressed.

When adsorption occurs between a toner particle and a toner particle dispersing agent due to an interaction such as, for example, an acid-base interaction, the toner particle dispersing agent is then easily released from the toner particle and the toner particle dispersibility cannot be stably maintained. In addition, the volume resistivity of the liquid developer is reduced by the toner particle dispersing agent that is released from the toner particle.

In the present disclosure, the at least one substructure selected from the group consisting of the substructure represented by formula (1) and the substructure represented by formula (1') is bonded through a covalent bond to the toner particle surface. That is, a compound having at least one substructure selected from the group consisting of a substructure represented by formula (3) and a substructure represented by formula (3') is covalently bonded to the toner particle surface. For example, covalent bonding occurs with the resin that constitutes the toner particle surface.

By adopting such a structure, the release of this substructure from the toner particle surface into the liquid carrier is impeded. The resulting liquid developer is thus able, even with elapsed time, to maintain a stable dispersibility and retain a high volume resistivity.

Each material is described in detail in the following.

Liquid Carrier

First, the liquid carrier should have a high volume resistivity, should be electrically insulating, and should be a low-viscosity liquid at around room temperature, but is not otherwise particularly limited.

The volume resistivity of the liquid carrier is preferably from $5\times10^{8}$ Ω·cm to $1\times10^{15}$ Ω·cm and is more preferably from $1\times10^{9}$ Ω·cm to $1\times10^{13}$ Ω·cm. Excellent developing properties can be exhibited by having the volume resistivity be in the indicated range.

The viscosity of the liquid carrier at 25° C. is preferably from 0.5 mPa·s to 100 mPa·s and is more preferably from 0.5 mPa·s to 20 mPa·s.

The SP value of the liquid carrier is preferably from 7.0 $(cal/cm^3)^{1/2}$ to 9.0 $(cal/cm^3)^{1/2}$ and is more preferably from 7.5 $(cal/cm^3)^{1/2}$ to 8.5 $(cal/cm^3)^{1/2}$. A good latent image retention and good developing characteristics can be obtained by having the SP value be in the indicated range.

This SP value is the solubility parameter. The SP value is a value introduced by Hildebrand and defined by a formal theory, and it is given by the square root of the cohesive energy density of the solvent (or solute) and is a measure of the solubility in a two-component system solution.

This SP value is the value calculated from the vaporization energy and molar volume of the atoms and atomic groups in accordance with Fedors as described in Basics and Technology of Coatings (page 53, Yuji Harasaki, Converting Technical Institute).

The unit for the SP value is $(cal/cm^3)^{1/2}$, but this can be converted to the $(J/m^3)^{1/2}$ unit using $$1\ (cal/cm^3)^{1/2}=2.046\times103\ (J/m^3)^{1/2}.$$

The liquid carrier can be specifically exemplified by hydrocarbon solvents such as octane, isooctane, decane, isodecane, decalin, nonane, dodecane, and isododecane and by paraffinic solvents such as Isopar E, Isopar G, Isopar H, Isopar L, Isopar M, and Isopar V (Exxon Mobil Corporation), Shellsol A100 and Shellsol A150 (Shell Chemicals Japan Ltd.), and Moresco White MT-30P (Moresco Corporation).

A single one of these liquid carriers may be used by itself or two or more may be used in combination.

A polymerizable liquid compound may be used as the liquid carrier. The polymerizable liquid compound should fulfill the properties of a liquid carrier, but is not otherwise particularly limited. The polymerizable liquid compound may be a component capable of undergoing polymerization by a photopolymerization reaction. The photopolymerization reaction may be a reaction induced by any type of light, but an ultraviolet-induced reaction is preferred. That is, the liquid carrier may be an ultraviolet-curable polymerizable liquid compound.

This polymerizable liquid compound may exhibit radical polymerizability, cationic polymerizability, or both, but any polymerizability may be used as appropriate.

Examples are vinyl ether compounds, urethane compounds, styrenic compounds, and acrylic compounds, as well as cyclic ether compounds such as epoxy compounds and oxetane compounds. A single one of the preceding compounds may be used by itself as the polymerizable liquid compound, or two or more may be used in combination.

Toner Particle

The toner particle is insoluble in the liquid carrier. In addition, the at least one substructure selected from the group consisting of the substructure represented by formula (1) below and the substructure represented by formula (1') below is bonded through a covalent bond to the toner particle surface.

Here, "insoluble in the liquid carrier" means that not more than 1 mass parts of the toner particle dissolves in 100 mass parts of the liquid carrier at a temperature of 25° C.

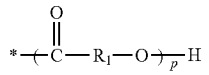

(1)

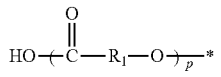

(1')

Where, $R_1$ represents a $C_{6-20}$ (preferably $C_{10-18}$) alkylene group optionally having a substituent or a $C_{6-20}$ (preferably $C_{10-18}$) cycloalkylene group having a substituent; p represents an integer equal to or greater than 1 (preferably 1 to 5); and * represents a bonding site to the toner particle surface.

The substituent that may be present on $R_1$ is not particularly limited, and can be exemplified by $C_{1-6}$ alkyl groups, $C_{1-6}$ alkoxy groups, halogen atoms, amino groups, hydroxy groups, carboxy groups, carboxylate ester groups, and carboxamide groups.

The bonding position of the oxygen atom that is bonded to $R_1$ may be the carbon atom at the terminal of $R_1$ or may be a nonterminal carbon atom in $R_1$.

Among these compounds, the self-condensates of hydroxycarboxylic acids such as 10-hydroxydecanoic acid and 12-hydroxystearic acid are more preferred.

Even more preferably the substructure represented by formula (1) and the substructure represented by formula (1') is a substructure represented by formula (2) below and a substructure represented by formula (2') below.

(2)

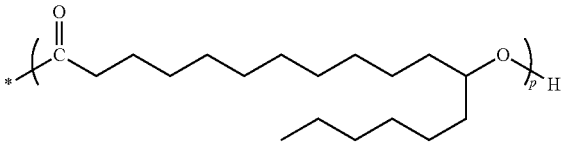

(2')

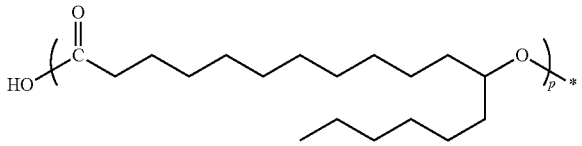

Where, p represents an integer equal to or greater than 1 (preferably from 1 to 5).

It is hypothesized that the release into the liquid carrier of the compound having this substructure is inhibited because the substructure is bonded via a covalent bond to the toner particle surface, and that as a consequence the toner particle dispersibility can be stably maintained even with elapsed time and a high volume resistivity can also be exhibited.

The following are examples of methods for effecting covalent bonding to the toner particle surface of the at least one substructure selected from the group consisting of the substructure represented by formula (1) and the substructure represented by formula (1'); however, there is no limitation to these. (i) A toner particle dispersing agent is obtained by reacting a compound having the substructure represented by formula (3) below with a basic compound having a primary amino group. This toner particle dispersing agent is reacted with an acid anhydride group-bearing binder resin to form an amide bond. (ii) A compound having the substructure represented by formula (3') below is reacted with an acid anhydride group-bearing binder resin to form an ester bond.

Method (i), in which an amide bond is formed, is preferred here from the standpoint of obtaining a better volume resistivity.

(3)

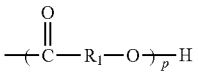

(3')

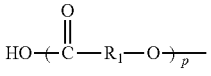

Where, $R_1$ represents a $C_{6-20}$ alkylene group optionally having a substituent or a $C_{6-20}$ cycloalkylene group optionally having a substituent, and p represents an integer equal to or greater than 1.

The toner particle preferably contains a binder resin. This binder resin more preferably has an acid anhydride group.

The acid anhydride group-bearing binder resin can be produced by a known method.

For example, after a resin having the desired composition and molecular weight has been synthesized, an acid anhydride group-bearing binder resin can be obtained by condensation of the molecular terminals with a carboxylic acid anhydride. In addition, a monomer composition can be obtained that contains a carboxylic acid anhydride and a monomer constituted of a resin having the desired composition and molecular weight, and the acid anhydride group-bearing binder resin can then be obtained by carrying out a polymerization reaction on this monomer composition. There are no particular limitations on the carboxylic acid anhydride, and known carboxylic acid anhydrides can be used. Specific examples are trimellitic anhydride, pyromellitic anhydride, and maleic anhydride.

The content of the acid anhydride group in the binder resin is preferably from 0.01 mmol/g to 0.10 mmol/g. The toner particle dispersion stability is further enhanced when this content is at least 0.01 mmol/g. When this content is not more than 0.10 mmol/g, the component released into the liquid carrier is suppressed and the volume resistivity of the liquid developer is then further enhanced. A more preferred range for this content is from 0.03 mmol/g to 0.07 mmol/g.

The group content of the acid anhydride group in the binder resin can be adjusted through judicious alteration of the amount of addition, during production of the binder resin, of the monomer that can introduce the acid anhydride group.

The basic compound having a primary amino group should be a compound that has a primary amino group and is basic, but is not otherwise particularly limited, and known compounds can be used. This "primary amino group" refers to the group represented by $—NH_2$. "Basic" refers to a pH greater than 7.

The basic compound having a primary amino group can be specifically exemplified by polyallylamines, such as the PAA series (Nittobo Medical Co., Ltd.), but there is no limitation to this.

The reaction of a basic compound having a primary amino group with a compound having the substructure represented by formula (3) can convert the compound having the substructure represented by formula (3) into one that additionally has a primary amino group.

The amine value of this compound having a substructure represented by formula (3) and also having a primary amino group is preferably at least 30 mg KOH/g and is more preferably at least 60 mg KOH/g. This amine value is preferably not more than 100 mg KOH/g. There are no limitations on the combinations with this numerical value range.

This amine value can be adjusted by appropriate alterations in the blending ratio between the basic compound having a primary amino group and the compound having a substructure represented by formula (3).

The content of the at least one substructure selected from the group consisting of the substructure represented by formula (1) and the substructure represented by formula (1'), per 100 mass parts of the binder resin, is preferably from 0.5 mass parts to 5.0 mass parts. A range from 1.0 mass parts to 4.0 mass parts is more preferred. In addition, a range from 0.5 mass parts to 5.0 mass parts per 100 mass parts of the binder resin is preferred for the content of the compound having at least one substructure selected from the group consisting of the substructure represented by formula (3) and the substructure represented by formula (3'). A range from 1.0 mass parts to 4.0 mass parts is more preferred. A better toner particle dispersibility is obtained by obeying this range.

This content can be adjusted by suitable alteration, during the production of the toner particle dispersing agent, of the blending amount for the basic compound having a primary amine and/or the blending amount for the compound having at least one substructure selected from the group consisting of the substructure represented by formula (3) and the substructure represented by formula (3').

The other materials are described in detail in the following.

There are no particular limitations on the binder resin, but the binder resin preferably contains polyester resin and more preferably is polyester resin. The polyester resin content in the binder resin is preferably from 50 mass % to 100 mass %.

The weight-average molecular weight (Mw) of this binder resin is preferably at least 15,000 and is more preferably at least 18,000. The weight-average molecular weight of the binder resin is preferably not more than 50,000. There are no limitations on the combinations with this numerical value range.

The weight-average molecular weight of the binder resin can be adjusted, for example, through suitable alteration of the polymerization conditions, e.g., the temperature, and/or the amount of monomer having three or more functional groups.

The content in the binder resin of a component having a molecular weight of not greater than 1,000 is preferably not more than 5 mass % and is more preferably not more than 4 mass %. The content in the binder resin of the component having a molecular weight of not greater than 1,000 can be adjusted, for example, through suitable alteration of the temperature and time during polymerization and the monomer composition.

The binder resin may also contain an acid anhydride group.

There are no particular limitations on the polyester resin, and examples here are condensation polymers between an alcohol monomer and a carboxylic acid monomer.

The alcohol monomer is exemplified by the following:

alkylene oxide adducts on bisphenol A, e.g., polyoxypropylene(2.2)-2,2-bis(4-hydroxyphenyl)propane, polyoxypropylene(3.3)-2,2-bis(4-hydroxyphenyl)propane, polyoxyethylene(2.0)-2,2-bis(4-hydroxyphenyl)propane, polyoxypropylene(2.0)-2,2-bis(4-hydroxyphenyl)propane, polyoxypropylene(2.0)-polyoxyethylene(2.0)-2,2-bis(4-hydroxyphenyl)propane, and polyoxypropylene(6)-2,2-bis(4-hydroxyphenyl)propane, as well as ethylene glycol, diethylene glycol, triethylene glycol, 1,2-propanediol, 1,3-propanediol, 1,4-butanediol, neopentyl glycol, 1,4-butenediol, 1,5-pentanediol, 1,6-hexanediol, 1,4-cyclohexanedimethanol, dipropylene glycol, polyethylene glycol, polypropylene glycol, polytetramethylene glycol, bisphenol A, hydrogenated bisphenol A, glycerol, sorbitol, 1,2,3,6-hexanetetrol, 1,4-sorbitan, pentaerythritol, dipentaerythritol, tripentaerythritol, 1,2,4-butanetriol, 1,2,5-pentanetriol, 2-methylpropanetriol, 2-methyl-1,2,4-butanetriol, trimethylolethane, trimethylolpropane, and 1,3,5-trihydroxymethylbenzene.

A single one of these alcohol monomers may be used by itself or two or more may be used in combination.

The carboxylic acid monomer, on the other hand, is exemplified by the following:

aromatic dicarboxylic acids such as phthalic acid, isophthalic acid, dihydroxyisophthalic acid, terephthalic acid, and dihydroxyterephthalic acid, and their anhydrides; alkyl dicarboxylic acids such as succinic acid, adipic acid, sebacic acid, and azelaic acid, and their anhydrides; succinic acid that has been substituted by a $C_{6-18}$ alkyl group or a $C_{6-18}$ alkenyl group, and their anhydrides; and unsaturated dicarboxylic acids such as fumaric acid, maleic acid, and citraconic acid, and their anhydrides.

A single one of these carboxylic acid monomers may be used by itself or two or more may be used in combination.

The following monomers may also be used in addition to the preceding:

polyhydric alcohols such as the oxyalkylene ethers of novolac-type phenolic resins, and polybasic carboxylic acids such as trimellitic acid, pyromellitic acid, and benzophenonetetracarboxylic acid, and their anhydrides.

Among the preceding, at least one of the carboxylic acid monomer and alcohol monomer preferably has an aromatic ring. The incorporation of an aromatic ring can reduce the crystallinity of the polyester resin and enhance the solubility in solvent.

The toner particle may contain, for its resin component, a resin other than the aforementioned polyester resin.

This resin can be exemplified by styrene-acrylic resins, polyurethane resins, epoxy resins, polyamide resins, polyimide resins, silicon resins, phenolic resins, melamine resins, urea resins, aniline resins, ionomer resins, and polycarbonate resins, and copolymers of the preceding.

A single one of these non-polyester resins may be used by itself or two or more may be used in combination.

The toner particle may contain a colorant.

There are no particular limitations on this colorant, and, for example, it may be a known organic pigment or inorganic pigment.

The following are specific examples of yellow pigments.

C. I. Pigment Yellow 1, 2, 3, 4, 5, 6, 7, 10, 11, 12, 13, 14, 15, 16, 17, 23, 62, 65, 73, 74, 83, 93, 94, 95, 97, 109, 110, 111, 120, 127, 128, 129, 147, 151, 154, 155, 168, 174, 175, 176, 180, 181, and 185; C.I. Vat Yellow 1, 3, and 20.

The following are specific examples of red or magenta pigments.

The following are specific examples of blue or cyan pigments.

C. I. Pigment Red 1, 2, 3, 4, 5, 6, 7, 8, 9, 10, 11, 12, 13, 14, 15, 16, 17, 18, 19, 21, 22, 23, 30, 31, 32, 37, 38, 39, 40, 41, 48:2, 48:3, 48:4, 49, 50, 51, 52, 53, 54, 55, 57:1, 58, 60, 63, 64, 68, 81:1, 83, 87, 88, 89, 90, 112, 114, 122, 123, 146, 147, 150, 163, 184, 202, 206, 207, 209, 238, and 269; C.I. Pigment Violet 19; C.I. Vat Red 1, 2, 10, 13, 15, 23, 29, and 35.

C. I. Pigment Blue 2, 3, 15:2, 15:3, 15:4, 16, and 17; C. I. Vat Blue 6; C. I. Acid Blue 45; and copper phthalocyanine pigments in which from 1 to 5 phthalimidomethyl groups are substituted on the phthalocyanine skeleton.

Green pigments can be exemplified by the following.

C. I. Pigment Green 7, 8, and 36.

Orange pigments can be exemplified by the following.

C. I. Pigment Orange 66 and 51.

Black pigments can be exemplified by the following.

Carbon black, titanium black, and aniline black.

White pigments can be exemplified by the following.

Basic lead carbonate, zinc oxide, titanium oxide, and strontium titanate.

A single one of these colorants may be used by itself or two or more may be used in combination.

A dispersing means may be used, in conformity with the toner particle production method, to disperse the pigment in the toner particle. Apparatuses that can be used as this dispersion means can be exemplified by the following: ball mills, sand mills, attritors, roll mills, jet mills, homogenizers, paint shakers, kneaders, agitators, the Henschel mixer, colloid mills, ultrasound homogenizers, pearl mills, and wet jet mills.

The colorant content, expressed per 100 mass parts of the resin component in the toner particle, is preferably from 1 mass parts to 100 mass parts and is more preferably from 5 mass parts to 50 mass parts.

A pigment dispersing agent may also be added when pigment dispersion is carried out.

This pigment dispersing agent can be exemplified by hydroxy group-bearing carboxylic acid esters, salts of high-molecular-weight acid esters with long-chain polyaminoamides, salts of high-molecular-weight polycarboxylic acids, high-molecular-weight unsaturated acid esters, high-molecular-weight copolymers, modified polyacrylates, aliphatic polybasic carboxylic acids, naphthalenesulfonic acid-formalin condensates, polyoxyethylene alkyl phosphate esters, and pigment derivatives. The use is also preferred of commercial high-molecular-weight dispersing agents such as the Solsperse series (Lubrizol Japan Ltd.) and the Vylon series (Toyobo Co., Ltd.).

A synergist, as a pigment co-dispersing agent, may also be used depending on various pigments.

These pigment dispersing agents and pigment co-dispersing agents may be used alone or in combination with two or more thereof. The amounts of addition of these pigment dispersing agent and pigment co-dispersing agent, per 100 mass parts of the pigment, are preferably from 1 mass parts to 60 mass parts.

When the liquid carrier is a component that can undergo polymerization by a photopolymerization reaction, a photopolymerization initiator may be used that generates acid or a radical upon impingement with light of a prescribed wavelength. In this case a suitable sensitizer and/or co-sensitizer may be used.

The liquid developer may optionally contain a charge control agent. A known charge control agent can be used as this charge control agent.

The charge control agent can be specifically exemplified by the following:

fats and oils such as linseed oil and soybean oil; alkyd resins; halogenated polymers; aromatic polycarboxylic acids; acidic group-containing water-soluble dyes; oxidative condensates of aromatic polyamines; metal soaps such as cobalt naphthenate, nickel naphthenate, iron naphthenate, zinc naphthenate, cobalt octylate, nickel octylate, zinc octylate, cobalt dodecylate, nickel dodecylate, zinc dodecylate, aluminum stearate, and cobalt 2-ethylhexanoate; metal sulfonate salts such as petroleum metal sulfonates and metal salts of sulfosuccinate esters; phospholipids such as hydrogenated lecithin and lecithin; metal salicylate salts such as metal complexes of t-butylsalicylic acid; polyvinylpyrrolidone resins; polyamide resins; sulfonic acid-containing resins; and hydroxybenzoic acid derivatives.

A single one of these charge control agents may be used by itself or two or more may be used in combination.

In addition to the components described in the preceding, various known additives may be used in the liquid developer on an optional basis with the goal of enhancing the recording media compatibility, storage stability, image preservability, and other capabilities.

For example, suitable selections from surfactants, lubricants, fillers, defoamants, ultraviolet absorbers, antioxidants, antifading agents, antimolds, rust inhibitors, and so forth can be used as additives.

Method of Producing Liquid Developer

The method according to the present disclosure is described in the following.

That is, the present disclosure relates to a method of producing a liquid developer containing a liquid carrier and a toner particle that is insoluble in the liquid carrier, the method comprising:

a step (I) of covalently bonding, to a surface of the toner particle, a compound having at least one substructure selected from the group consisting of a substructure represented by formula (3) below and a substructure represented by formula (3') below.

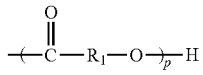

(3)

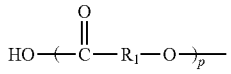

(3')

Where, $R_1$ represents a $C_{6-20}$ (preferably $C_{10-18}$) alkylene group optionally having a substituent or a $C_{6-20}$ (preferably $C_{10-18}$) cycloalkylene group optionally having a substituent, and p represents an integer equal to or greater than 1 (preferably 1 to 5).

The substituent that may be present on $R_1$ is not particularly limited, and can be exemplified by $C_{1-6}$ alkyl groups, $C_{1-6}$ alkoxy groups, halogen atoms, amino groups, hydroxy groups, carboxy groups, carboxylate ester groups, and carboxamide groups.

The bonding position of the oxygen atom that is bonded to $R_1$ may be the carbon atom at the terminal of $R_1$ or may be a nonterminal carbon atom in In specific terms, the coacervation method may be used as the method of producing the liquid developer.

The coacervation method is described in, for example, Japanese Patent Application Laid-open No. 2003-241439, WO 2007/000974, and WO 2007/000975.

In the coacervation method, binder resin, solvent that dissolves the binder resin, a toner particle dispersing agent, and solvent that does not dissolve the binder resin (for example, the liquid carrier) are mixed, and the solvent that dissolves the binder resin is removed from the resulting mixture in order to precipitate the binder resin that has been residing in the dissolved state, resulting in the dispersion of toner particles in the solvent that does not dissolve the binder resin.

The step (I) in the production method preferably includes:

a step of preparing a liquid mixture that contains a binder resin having an acid anhydride group and a compound having at least one substructure selected from the group consisting of the substructure represented by formula (3) and the substructure represented by formula (3'); and a step of adding a liquid carrier to the liquid mixture.

In order to bring about the formation of a covalent bond between the toner particle surface and the compound having at least one substructure selected from the group consisting of the substructure represented by formula (3) and the substructure represented by formula (3'), preferably the binder resin to be incorporated in the toner particle is dissolved in solvent that dissolves said binder resin; this is followed by the addition to this solution of a compound having at least one substructure selected from the group consisting of the substructure represented by formula (3) and the substructure represented by formula (3'); and mixing is carried out. Stirring for about 1 hour using a stirring device, e.g., a homogenizer, is preferably performed in this mixing step.

Solvent that can be used in the aforementioned step should be a solvent that can dissolve the binder resin, but is not otherwise particularly limited. Examples here are ethers such as tetrahydrofuran; ketones such as acetone, methyl ethyl ketone, and cyclohexanone; esters such as ethyl acetate; and halogenated solvents such as chloroform. In addition, when the aforementioned polyester resin is be dissolved, this solvent may be an aromatic hydrocarbon such as toluene or benzene.

More preferably, the substructure represented by formula (3) is a substructure represented by formula (4) below and the substructure represented by formula (3') is a substructure represented by formula (4') below.

(4)

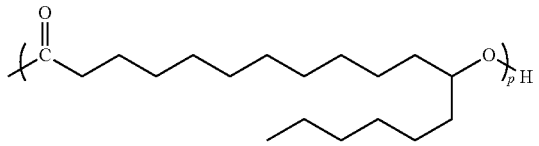

(4')

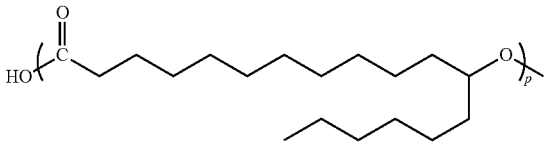

Where, p represents an integer equal to or greater than 1.

The measurement methods used for the examples are considered in the following.

Method of Determining Status of Bonding Between Toner Particle Surface and at Least One Substructure Selected from Group Consisting of Substructure Represented by Formula (1) and Substructure Represented by Formula (1')

The following method is used to determine whether covalent bonding occurs between the toner particle surface and the at least one substructure selected from the group consisting of the substructure represented by formula (1) and the substructure represented by formula (1').

A 0.1 mol/L ethanolic hydrochloric acid solution is added, at 1 mass parts per 100 mass parts of the liquid carrier in the liquid developer, to 10 g of the liquid developer, followed by shaking for 5 minutes and visual determination of the presence/absence of aggregation. When the toner particles undergo aggregation, bonding between the toner particle surface and substructure is scored as occurring via an acid-base interaction. When the toner particles do not undergo aggregation, bonding between the toner particle surface and the substructure is scored as occurring via covalent bonding.

The covalent bond is identified as being an amide bond or ester bond using a Fourier transform infrared spectrophotometer (FTIR, Spectrum One, PerkinElmer Inc.) and 1 g of the toner particle obtained by carrying out centrifugal separation (150 rpm, 30 minutes) on 10 g of the liquid developer. When an increase in the peak at 1,650 $cm^{-1}$ is seen, this is scored as meaning that the toner particle surface is bonded to the substructure through an amide bond. When an increase in the peak at 1,175 $cm^{-1}$ is seen, this is scored as meaning that the toner particle surface is bonded to the substructure through an ester bond.

When at least one selected from the group consisting of the substructure and the binder resin present in the toner particle has at least one bond selected from the group consisting of an amide bond and an ester bond, the amide bond and the ester bond are discriminated using the following method from the amide bond or the ester bond formed between the toner particle surface and the compound.

The binder resin is separated from the liquid developer using the method described below and the IR spectrum of the binder resin is obtained. The substructure is also separated from the liquid developer using the method described below and the IR spectrum of this substructure is obtained. Discrimination is performed by analyzing the difference between these IR spectra and the IR spectrum of the sample, obtained by the method described above, in which the toner particle is covalently bonded to the substructure.

Measurement of Content of at Least One Substructure Selected from Group Consisting of Substructure Represented by Formula (1) and Substructure Represented by Formula (1'), and Identification of Structure of This Substructure The following procedure is used to calculate the content of the at least one substructure selected from the group consisting of the substructure represented by formula (1) and the substructure represented by formula (1').

First, 1 g of the toner particle, obtained by the centrifugal separation (150 rpm, 30 minutes) of 10 g of the liquid developer, is dissolved in 100 mL of toluene. To this is added 10 mL of a 1 mol/L ethanolic potassium hydroxide solution, and hydrolysis is carried out by heating (60° C., 15 minutes). The resulting solution is cooled to 25° C. and 100 mL of hexane is added and extraction and separation are performed to yield a solution, which is dried. The resulting solid fraction is quantitated as the content of the substructure with reference to the binder resin.

The structure of this substructure is identified by dissolving 0.01 g of the obtained solid fraction in 5 g of deuterochloroform and carrying out analysis using a JNM-ECA ($^1$H-NMR) Fourier transform nuclear magnetic resonance instrument from JEOL Ltd.

Method of Measuring Weight-Average Molecular Weight of Binder Resin and Content of Component Having a Molecular Weight of Not Greater Than 1,000

The weight-average molecular weight (Mw) of the binder resin and the content in the binder resin of the component having a molecular weight of not greater than 1,000 are calculated as polystyrene using gel permeation chromatography (GPC). The measurement of the molecular weight by GPC is described in the following.

First, 1 g of the toner particle, obtained by the centrifugal separation (150 rpm, 30 minutes) of 10 g of the liquid developer, is dissolved in 100 mL of toluene. To this is added 10 mL of a 1 mol/L ethanolic potassium hydroxide solution, and hydrolysis is carried out by heating (60° C., 15 minutes). The resulting solution is cooled to 25° C. and 100 mL of hexane is added and extraction and separation are performed to yield a solution, which is dried. The resulting solid fraction is dissolved in THF, and the filtered solution is dried to obtain the binder resin.

When the binder resin as such can be separately acquired, the following GPC may also be carried out using this.

The obtained binder resin is then added to the following solution so as to provide a binder resin concentration of 1.0 mass %, and dissolution is carried out by standing at quiescence for 24 hours at room temperature to provide a solution. This solution is filtered across a solvent-resistant membrane filter having a pore diameter of 0.20 μm to provide the sample solution, which is measured using the following conditions.

instrument: "HLC-8220GPC" high-performance GPC instrument [Tosoh Corporation]
column: 2 x LF-804
eluent: tetrahydrofuran (THF)
flow rate: 1.0 mL/min
oven temperature: 40° C.
sample injection amount: 0.025 mL A molecular weight calibration curve constructed using polystyrene resin standards [TSK Standard Polystyrene F-850, F-450, F-288, F-128, F-80, F-40, F-20, F-10, F-4, F-2, F-1, A-5000, A-2500, A-1000, A-500, Tosoh Corporation] is used to determine the molecular weight of the sample.

Method of Measuring Content of Acid Anhydride Group

The acid anhydride group content is measured proceeding as follows. 1 g of the binder resin is dissolved in 100 mL of tetrahydrofuran; 20 mL of an ethanol solution containing 0.1 mol/L octylamine is added; and the octylamine and acid anhydride group are reacted. The excess octylamine is then titrated with a 0.01 mol/L hydrochloric acid-ethanol mixed solution.

In addition, measurement is carried out using the following method when the content of the acid anhydride group cannot be measured by the method described above.

0.1 g of the binder resin is dissolved in 10 mL of deuterochloroform and compositional analysis of the binder resin is carried out using a JNM-ECA ($^1$-NMR) Fourier transform nuclear magnetic resonance instrument from JEOL Ltd. Using FT-IR and the ATR method, the content of the acid anhydride group is calculated by comparing the magnitude of the peak at 1,780 $cm^{-1}$, which is characteristic of the acid anhydride group, with the carbonyl peak in the vicinity of 1,770 $cm^{-1}$, which is characteristic of the carboxy group. The carboxy group content is calculated using a Fourier transform nuclear magnetic resonance instrument.

The binder resin is separated from the liquid developer using the following method.

First, 1 g of the toner particle, obtained by the centrifugal separation (150 rpm, 30 minutes) of 10 g of the liquid developer, is dissolved in 100 mL of toluene. To this is added 10 mL of a 1 mol/L ethanolic potassium hydroxide solution, and hydrolysis is carried out by heating (60° C., 15 minutes). The resulting solution is cooled to 25° C. and 100 mL of hexane is added and extraction and separation are performed to yield a solution, which is dried. The resulting solid fraction is dissolved in THF, and the filtered solution is dried to obtain the binder resin.

Method of Measuring Amine Value of Compound Having a Substructure Represented by Formula (3)

The basic procedure for measuring the amine value of the compound having a substructure represented by formula (3) is based on ASTM D2074.

The determination is specifically carried out using the following method.

1) A range from 0.5 g to 2.0 g of the compound having a substructure represented by formula (3) is exactly weighed. This mass is designated M2 (g).

2) The sample is introduced into a 50-mL beaker and 25 mL of tetrahydrofuran/ethanol mixed solvent (3/1) is added and dissolution is carried out.

3) Titration is performed at 25° C. using a 0.1 mol/L ethanolic HCl solution and a potentiometric titrator ["COM-2500" Automatic Titrator from Hiranuma Sangyo Co., Ltd.].

4) The amount of the HCl solution used here is designated S (mL). The blank is measured at the same time, and the amount of HCl used in this case is designated B2 (mL).

5) The amine value is calculated using the following formula. Here, f is the factor for the HCl solution.

$$\text{amine value [mg KOH/g]}=(S-B2)\times f\times 5.61/M2$$

The following method is used to separate the compound having a substructure represented by formula (3) from the liquid developer.

First, 1 g of the toner particle, obtained by the centrifugal separation (150 rpm, 30 minutes) of 10 g of the liquid developer, is dissolved in 100 mL of toluene. To this is added 10 mL of a 1 mol/L ethanolic potassium hydroxide solution, and hydrolysis is carried out by heating (60° C., 15 minutes). The resulting solution is cooled to 25° C. and 100 mL of hexane is added and extraction and separation are performed to yield a solution, which is dried. The resulting solid fraction is dissolved in THF, and the insoluble fraction separated by filtration is dried to yield the compound having a substructure represented by formula (3).

Method of Measuring Volume Resistivity of Liquid Developer

The volume resistivity is measured using an R8340A digital ultrahigh resistance/microcurrent meter (ADC Corporation). For the measurement, 25 mL of the sample is introduced into an SME-8330 liquid sample electrode (Hioki E. E. Corporation), and the measurement is performed by the application of 1,000 V direct current at a room temperature of 25° C.

Method of Measuring Toner Particle Diameter

The particle diameter of the toner particle is measured using a Microtrac HRA (X-100) (Nikkiso Co., Ltd.) particle size distribution analyzer. The measurement is run using a range setting from 0.001 μm to 10 μm, and the measurement is carried out to give the volume median diameter D50.

EXAMPLES

The present disclosure is described in detail in the following using examples, but the present disclosure is not limited to or by these examples. Unless specifically indicated otherwise, "parts" denotes "mass parts".

Binder Resin 1 Production Example

The following materials were added to a reaction kettle equipped with a stirrer, thermometer, and reflux condenser and a transesterification reaction was run for two hours at 220° C.:

134 parts of terephthalic acid (TPA), 167 parts of isophthalic acid (IPA), 432 parts of a 2 mol adduct of ethylene oxide on bisphenol A (BPA-EO), 99 parts of ethylene glycol (EG), 62 parts of neopentyl glycol (NPG), 0.07 parts of n-tetrabutyl titanate as catalyst, 3 parts of Irganox 1330 (BASF) as antioxidant, and 0.3 parts of sodium acetate as polymerization stabilizer.

This was followed by reducing the pressure within the reaction system while raising the temperature of the system from 220° C. to 270° C., and a polymerization reaction was then run for 10 hours at not above 1 Ton to obtain a polyester resin.

After completion of the reaction, the system was returned to normal pressure using nitrogen.

In order to add an acid anhydride group to the obtained polyester resin, 106 parts of trimellitic anhydride (TMA) was introduced and a reaction was run for 30 minutes at 220° C. to yield a binder resin 1. The properties of the obtained binder resin 1 are shown in Table 2.

Binder Resins 2 to 7 Production Example

Binder resins 2 to 7 were obtained proceeding as in the Binder Resin 1 Production Example, but changing the monomer type and amount of addition and the reaction conditions as described in Table 1. The properties of the obtained binder resins 2 to 7 are given in Table 2.

Binder Resin 8 Production Example

The following materials were added to a reaction kettle equipped with a stirrer, thermometer, and reflux condenser and a transesterification reaction was run for two hours at 220° C.:

134 parts of terephthalic acid (TPA), 167 parts of isophthalic acid (IPA), 432 parts of a 2 mol adduct of ethylene oxide on bisphenol A (BPA-EO), 99 parts of ethylene glycol (EG), 62 parts of neopentyl glycol (NPG), 0.01 parts of n-tetrabutyl titanate as catalyst, 3 parts of Irganox 1330 (BASF) as antioxidant, and 0.3 parts of sodium acetate as polymerization stabilizer.

This was followed by reducing the pressure within the reaction system while raising the temperature of the system from 220° C. to 270° C., and a polymerization reaction was then run for 6 hours at not above 1 Torr to obtain a polyester resin.

After completion of the reaction, the system was returned to normal pressure using nitrogen to yield a binder resin 8. The properties of the obtained binder resin 7 are given in Table 2.

TABLE 2

| | Mw | Component with a molecular weight of 1,000 or less [mass %] | Amount of acid anhydride [mmol/g] |
|---|---|---|---|
| Resin 1 | 20000 | 3 | 0.05 |
| Resin 2 | 18000 | 4 | 0.02 |
| Resin 3 | 23000 | 6 | 0.08 |
| Resin 4 | 16000 | 4 | 0.05 |
| Resin 5 | 14000 | 4 | 0.05 |
| Resin 6 | 13000 | 6 | 0.05 |
| Resin 7 | 22000 | 3 | 0.12 |
| Resin 8 | 16000 | 3 | 0.00 |
| Resin 9 | 13000 | 6 | 0.06 |

12-Hydroxystearic Acid Self-Condensate Production Example 30.0 parts of xylene (Junsei Chemical Co., Ltd.), 300.0 parts of 12-hydroxystearic acid (Junsei Chemical Co., Ltd.), and 0.1 parts of tetrabutyl titanate (Tokyo Chemical Industry Co., Ltd.) were introduced into a reaction flask fitted with a thermometer, stirrer, nitrogen introduction port, reflux condenser, and water separator, and the temperature was raised to 160° C. over 4 hours under a nitrogen current.

Heating for an additional 4 hours at 160° C. was carried out and the xylene was distilled off at 160° C.

Cooling to room temperature was then carried out; the water produced during the reaction while heating was separated from the xylene in the distillate; and this xylene was returned to the reaction solution. This reaction solution was designated the 12-hydroxystearic acid self-condensate. The weight-average molecular weight of the resulting 12-hydroxystearic acid self-condensate was 1,350.

10-Hydroxydecanoic Acid Self-Condensate Production Example 30.0 parts of xylene (Junsei Chemical Co., Ltd.), 300.0 parts of 10-hydroxydecanoic acid, and 0.1 parts of tetrabutyl titanate (Tokyo Chemical Industry Co., Ltd.) were introduced into a reaction flask fitted with a thermometer, stirrer, nitrogen introduction port, reflux condenser, and water separator, and the temperature was raised to 160° C. over 4 hours under a nitrogen current.

Heating for an additional 4 hours at 160° C. was carried out and the xylene was distilled off at 160° C.

Cooling to room temperature was then carried out; the water produced during the reaction while heating was separated from the xylene in the distillate; and this xylene was returned to the reaction solution. This reaction solution was designated the 10-hydroxydecanoic acid self-condensate. The weight-average molecular weight of the resulting 10-hydroxydecanoic acid self-condensate was 820.

TABLE 1

| | TPA [parts] | IPA [parts] | BPA-EO [parts] | EG [parts] | NPG [parts] | TMA [parts] | Styrene [parts] | Butyl acrylate [parts] | Maleic anhydride [parts] | n-tetrabutyl titanate [parts] | Polymerization reaction time [h] |
|---|---|---|---|---|---|---|---|---|---|---|---|
| Resin 1 | 134 | 167 | 432 | 99 | 62 | 106 | 0 | 0 | 0 | 0.07 | 10 |
| Resin 2 | 134 | 167 | 432 | 99 | 62 | 53 | 0 | 0 | 0 | 0.07 | 8 |
| Resin 3 | 134 | 167 | 432 | 99 | 62 | 152 | 0 | 0 | 0 | 0.07 | 6 |
| Resin 4 | 134 | 167 | 432 | 99 | 62 | 106 | 0 | 0 | 0 | 0.03 | 8 |
| Resin 5 | 134 | 167 | 432 | 99 | 62 | 106 | 0 | 0 | 0 | 0.03 | 7 |
| Resin 6 | 134 | 167 | 432 | 99 | 62 | 106 | 0 | 0 | 0 | 0.01 | 6 |
| Resin 7 | 134 | 167 | 432 | 99 | 62 | 182 | 0 | 0 | 0 | 0.01 | 6 |
| Resin 8 | 134 | 167 | 432 | 99 | 62 | 0 | 0 | 0 | 0 | 0.01 | 6 |
| Resin 9 | 0 | 0 | 0 | 0 | 0 | 0 | 600 | 350 | 50 | 0 | 12 |

Binder Resin 9 Production Example

| | |
|---|---|
| solvent: toluene | 1,000 parts |
| monomer composition (the monomer composition was obtained by mixing styrene, butyl acrylate, and maleic anhydride in the proportions given below) | 1,000 parts |
| styrene | 600 parts |
| butyl acrylate | 350 parts |
| maleic anhydride | 50 parts |
| t-butyl peroxypivalate polymerization initiator (Perbutyl PV, NOF Corporation) | 5 parts |

These materials were introduced under a nitrogen atmosphere into a reactor equipped with a reflux condenser, stirrer, thermometer, and nitrogen introduction line. While stirring the reactor contents at 200 rpm, heating was carried out to 70° C. and a polymerization reaction was run for 12 hours to obtain a solution in which a polymer of the monomer composition was dissolved in toluene. The temperature of this solution was then reduced to 25° C., followed by the introduction with stirring of this solution into 5,000.0 parts of methanol in order to precipitate the methanol-insoluble fraction. The obtained methanol-insoluble fraction was separated by filtration and washed with methanol, followed by vacuum-drying for 24 hours at 40° C. to yield a binder resin 8. The properties of the obtained binder resin 8 are given in Table 2.

Toner Particle Dispersing Agent 1 Production Example 25.0 parts of xylene and 70.0 parts of a 10% aqueous solution of the polyallylamine "PAA-1LV" (Nittobo Medical Co., Ltd., number-average molecular weight (Mn): 3,000) were introduced into a reaction flask fitted with a thermometer, stirrer, nitrogen introduction port, reflux condenser, and water separator and the temperature was raised to 160° C. while stirring. 69.6 parts of the aforementioned 12-hydroxystearic acid self-condensate was added to the reaction solution (amine value directly after mixing=86.5 mg KOH/g) while distilling the water from the reaction solution using the water separator and returning the xylene to the reaction solution. A reaction was run for 2 hours at 160° C. to obtain a toner particle dispersing agent 1 [amine value=70.0 mg KOH/g].

Toner Particle Dispersing Agent 2 Production Example 25.0 parts of xylene and 70.0 parts of a 10% aqueous solution of the polyallylamine "PAA-1LV" (Nittobo Medical Co., Ltd., number-average molecular weight (Mn): 3,000) were introduced into a reaction flask fitted with a thermometer, stirrer, nitrogen introduction port, reflux condenser, and water separator and the temperature was raised to 160° C. while stirring. 69.6 parts of the aforementioned 10-hydroxydecanoic acid self-condensate was added to the reaction solution (amine value directly after mixing=82.5 mg KOH/g) while distilling the water from the reaction solution using the water separator and returning the xylene to the reaction solution. A reaction was run for 2 hours at 160° C. to obtain a toner particle dispersing agent 2 [amine value=35.0 mg KOH/g].

Toner Particle Dispersing Agent 3 Production Example 25.0 parts of xylene and 70.0 parts of a 10% aqueous solution of the polyallylamine "PAA-1C" (Nittobo Medical Co., Ltd., number-average molecular weight (Mn): 10,000) were introduced into a reaction flask fitted with a thermometer, stirrer, nitrogen introduction port, reflux condenser, and water separator and the temperature was raised to 160° C. while stirring. 69.6 parts of the aforementioned 12-hydroxystearic acid self-condensate was added to the reaction solution (amine value directly after mixing=59.0 mg KOH/g) while distilling the water from the reaction solution using the water separator and returning the xylene to the reaction solution. A reaction was run for 2 hours at 160° C. to obtain a toner particle dispersing agent 3 [amine value=29.0 mg KOH/g].

Charge Control Agent Production Example 17.9 parts of 2-(methacryloyloxy)ethyl 2-(trimethylammonio)ethyl phosphate, 82.1 parts of octadecyl methacrylate, 4.1 parts of azobisisobutyronitrile, and 900 parts of n-butanol were introduced into a reactor fitted with a condenser, stirrer, thermometer, and nitrogen introduction line and bubbling with nitrogen was carried out for 30 minutes.

The resulting mixture was heated for 8 hours at 65° C. under a nitrogen atmosphere to complete the polymerization reaction.

The solvent was distilled off under reduced pressure after the reaction solution had been cooled to room temperature.

The resulting residue was dissolved in chloroform and purification by dialysis was carried out using a dialysis membrane (Spectra/Por7 MWCO 1 kDa, Spectrum Laboratories, Inc.).

After the purification by dialysis, drying was carried out at 50° C. under reduced pressure at 0.1 kPa or below to obtain the charge control agent.

Charge Control Agent Dispersion Preparation 6.2 parts of the charge control agent and 68.2 parts of tetrahydrofuran were introduced into a reactor fitted with a stirrer and thermometer and the temperature was raised to 60° C. and the charge control agent was dissolved.

To this was added 61.3 parts of Moresco White MT-30P (Moresco Corporation), followed by distillative removal of the tetrahydrofuran under reduced pressure at 50° C. and 4 kPa to obtain a charge control agent dispersion in the form of a transparent reverse micelle liquid.

Liquid Developer 1 Production Example 30 parts of Pigment Blue 15:3 (ECB-308, Dainichiseika Color & Chemicals Mfg. Co., Ltd.), 47 parts of Vylon UR4800 (resin concentration=32%, Toyobo Co., Ltd.), 255 parts of tetrahydrofuran, and 130 parts of glass beads (diameter=1 mm) were mixed, and this was dispersed for 3 hours using an attritor (Nippon Coke & Engineering Co., Ltd.). This was followed by filtration across a mesh to remove the glass beads and yield a pigment dispersion 1.

2.0 parts of toner particle dispersing agent 1 was then mixed in small portions into 126 parts of a tetrahydrofuran solution of binder resin 1 (solids fraction: 50 mass %) while stirring at 20° C. using a high-speed stirrer (T. K. Robomix/T. K. Homodisper Model 2.5 blades, PRIMIX Corporation) to obtain a resin dispersion 1.

A toner material dispersion 1 was then obtained by mixing the resulting resin dispersion 1 with 180 parts of the pigment dispersion 1.

A mixture was prepared by adding 70 parts of Moresco White MT-30P (SP value: 7.90 $(cal/cm^3)^{1/2}$, Moresco Corporation) as the liquid carrier in small portions to 100 parts of the toner material dispersion 1 while stirring at a rotation rate of 25,000 rpm using a homogenizer (Ultra-Turrax T50, IKA).

The resulting mixture was transferred to a recovery flask and the tetrahydrofuran was completely distilled off at 50° C. while dispersing with ultrasound to obtain a toner particle dispersion.

A liquid developer 1 was obtained by mixing 0.12 parts of the charge control agent dispersion and 89.88 parts of Moresco White MT-30T into 10 parts of this toner particle dispersion.

Liquid Developers 2 to 15 Production Example

Liquid developers 2 to 15 were obtained proceeding as in the Liquid Developer 1 Production Example, but changing the type and amount of the materials used and the reaction conditions as indicated in Table 3.

COMPARATIVE EXAMPLES

Liquid Developer 16 Production Example

Liquid developer 16 was obtained proceeding as in the Liquid Developer 1 Production Example, but changing the type of materials used and the reaction conditions as indicated in Table 3.

Liquid Developer 17 Production Example 36 parts of resin 1, 9 parts of Pigment Blue 15:3 (ECB-308, Dainichiseika Color & Chemicals Mfg. Co., Ltd.), and 15 parts of Vylon UR4800 (resin concentration=32%, Toyobo Co., Ltd.) were thoroughly mixed using a Henschel mixer. Melt-kneading was then carried out using a co-rotating twin-screw extruder with a roll interior heating temperature of 100° C. The resulting mixture was cooled and coarsely pulverized to obtain a coarsely pulverized toner particle.

160 parts of Moresco White MT-30P (SP value: 7.90 $(cal/cm^3)^{1/2}$, Moresco Corporation) as the liquid carrier was combined with 40 parts of the coarsely pulverized toner obtained as described above and 2.0 parts of dispersing agent 2. Mixing for 24 hours with a sand mill gave a toner particle dispersion.

A liquid developer 17 was obtained by mixing 0.12 parts of the charge control agent dispersion and 89.88 parts of Moresco White MT-30T into 10 parts of this toner particle dispersion.

TABLE 3

| | Liquid developer | Resin | Dispersing agent | amount of resin dispersion [parts] | amount of dispersing agent [parts] | *1 | *2 | Toner particle diameter D50 [nm] |
|---|---|---|---|---|---|---|---|---|
| Examples | 1 | Resin 1 | Dispersing agent 1 | 126 | 2.0 | Covalent bond (amide bond) | 1.5% | 720 |
| | 2 | Resin 2 | Dispersing agent 1 | 126 | 1.0 | Covalent bond (amide bond) | 0.8% | 930 |
| | 3 | Resin 3 | Dispersing agent 1 | 126 | 2.4 | Covalent bond (amide bond) | 2.0% | 600 |
| | 4 | Resin 4 | Dispersing agent 1 | 126 | 2.0 | Covalent bond (amide bond) | 1.5% | 650 |
| | 5 | Resin 5 | Dispersing agent 1 | 126 | 2.0 | Covalent bond (amide bond) | 1.5% | 580 |
| | 6 | Resin 6 | Dispersing agent 1 | 126 | 2.0 | Covalent bond (amide bond) | 1.5% | 570 |
| | 7 | Resin 9 | Dispersing agent 1 | 126 | 2.0 | Covalent bond (amide bond) | 1.5% | 890 |
| | 8 | Resin 9 | Dispersing agent 2 | 126 | 3.0 | Covalent bond (amide bond) | 1.5% | 910 |
| | 9 | Resin 9 | Dispersing agent 2 | 126 | 1.3 | Covalent bond (amide bond) | 0.6% | 1220 |
| | 10 | Resin 9 | Dispersing agent 2 | 126 | 10.0 | Covalent bond (amide bond) | 4.7% | 820 |
| | 11 | Resin 9 | Dispersing agent 2 | 126 | 0.5 | Covalent bond (amide bond) | 0.3% | 1300 |
| | 12 | Resin 9 | Dispersing agent 2 | 126 | 12.0 | Covalent bond (amide bond) | 6.0% | 920 |
| | 13 | Resin 6 | Dispersing agent 3 | 126 | 12.0 | Covalent bond (amide bond) | 4.0% | 1030 |
| | 14 | Resin 7 | Dispersing agent 1 | 126 | 6.0 | Covalent bond (amide bond) | 4.0% | 810 |
| | 15 | Resin 7 | 12-hydroxystearic acid self-condensate | 126 | 6.0 | Covalent bond (ester bond) | 2.0% | 1080 |
| Comparative Examples | 16 | Resin 8 | Dispersing agent 2 | 126 | 2.0 | Covalent bond not present (acid-base interaction) | 0.0% | 880 |
| | 17 | Resin 1 | Dispersing agent 2 | 126 | 2.0 | Covalent bond not present (acid-base interaction) | 0.0% | 1200 |

*1: bonding regime between the toner particle surface and the at least one substructure selected from the group consisting of the substructure represented by formula (1) and the substructure represented by formula (1')
*2: content, with reference to the binder resin, of the at least one substructure selected from the group consisting of the substructure represented by formula (1) and the substructure represented by formula (1') (Actual value measured by the measurement method described above.)

Evaluation of Liquid Developers

Liquid developers 1 to 17 were evaluated using the following methods.

Evaluation of Volume Resistivity

The volume resistivity of the liquid developers was measured by the method described above.

The evaluation criteria are as follows.

A: $1\times10^{10}$ Ω·cm≤(volume resistivity)

B: $1\times10^{9}$ Ω·cm≤(volume resistivity)<$1\times10^{10}$ Ω·cm

C: $5\times10^{8}$ Ω·cm≤(volume resistivity)<$1\times10^{9}$ Ω·cm

D: $1\times10^{8}$ Ω·m≤(volume resistivity)<$5\times10^{8}$ Ω·cm

E: (volume resistivity)<$1\times10^{8}$ Ω·cm

In this evaluation, the effects of the present disclosure were considered to be obtained when the score was A, B, or C. The results of the evaluation are given in Table 4.

Measurement of Dispersion Stability

The liquid developer was stored for 2 months at 40° C. Using a Microtrac HRA (X-100) (Nikkiso Co., Ltd.) particle size distribution analyzer and a range setting from 0.001 μm to 10 μm, the volume median diameter D50 of the toner particles was measured before and after storage. The toner particle dispersion stability was evaluated using the ratio between the toner particle diameters post-versus-pre-storage (toner particle diameter post-storage/toner particle diameter pre-storage).

The evaluation criteria for the dispersion stability are given below. In this evaluation, the effects of the present disclosure were considered to be obtained when the score was A, B, or C. The results obtained for the evaluation are given in Table 4.

A: (toner particle diameter ratio post-versus-pre-storage) ≤1.1

B: 1.1<(toner particle diameter ratio post-versus-pre-storage)≤1.2

C: 1.2<(toner particle diameter ratio post-versus-pre-storage)≤1.5

D: 1.5<(toner particle diameter ratio post-versus-pre-storage)

TABLE 4

| | Liquid developer | Evaluation results: Volume resistivity | Evaluation results: Dispersion stability |
|---|---|---|---|
| Examples | Liquid developer 1 | A | A |
| | Liquid developer 2 | A | A |
| | Liquid developer 3 | A | A |
| | Liquid developer 4 | A | A |
| | Liquid developer 5 | B | A |
| | Liquid developer 6 | B | A |
| | Liquid developer 7 | C | A |
| | Liquid developer 8 | C | B |
| | Liquid developer 9 | C | B |
| | Liquid developer 10 | C | B |
| | Liquid developer 11 | C | C |
| | Liquid developer 12 | C | C |
| | Liquid developer 13 | C | C |
| | Liquid developer 14 | C | C |
| | Liquid developer 15 | C | C |
| Comparative Examples | Liquid developer 16 | D | D |
| | Liquid developer 17 | E | D |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2019-031466, filed Feb. 25, 2019 which is hereby incorporated by reference herein in its entirety.

What is claimed is:

1. A liquid developer, comprising:

a liquid carrier; and a toner particle having a surface comprising a binder resin, the binder resin being a reaction product of (i) a resin having an acid anhydride group and (ii) a compound having a primary amino group and a substructure represented by formula (3)

(3)

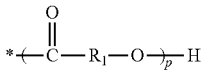

where $R_1$ represents an optionally substituted $C_{6-20}$ alkylene group or an optionally substituted $C_{6-20}$ cycloalkylene group, and p is an integer of at least 1, wherein the acid anhydride group has been reacted with the primary amino group thereby forming an amide bond binding the resin and the compound to form the binder resin having the substructure, the substructure in the binder resin being covalently bonded to the surface of the toner particle, and the toner particle is insoluble in the liquid carrier.

2. The liquid developer according to claim 1, wherein the resin having an acid anhydride group has a weight-average molecular weight of at least 15,000, and the resin having an acid anhydride group contains no more than 5 mass % of a component having a molecular weight not greater than 1,000.

3. The liquid developer according to claim 1, wherein the resin having an acid anhydride group has an acid anhydride content of 0.01 to 0.10 mmol/g.

4. The liquid developer according to claim 1, wherein the substructure represented by formula (3) is represented by formula (4)

(4)

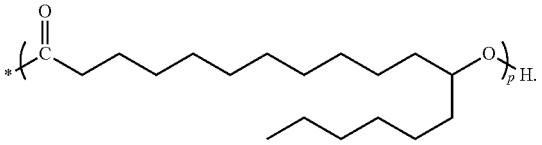

5. The liquid developer according to claim 1, wherein the compound having the primary amino group and substructure represented by formula (3) has an amine value of at least 30 mg KOH/g.

* * * * *